US005813175A

United States Patent [19]

Hiragaki

[11] Patent Number: 5,813,175

[45] Date of Patent: Sep. 29, 1998

[54] APPARATUS AND METHOD FOR PROCTECTING BUILDING FROM EARTHQUAKES

[75] Inventor: Minoru Hiragaki, Shimizu, Japan

[73] Assignee: Air House Company, Shimizu, Japan

[21] Appl. No.: 775,200

[22] Filed: Dec. 30, 1996

[30] Foreign Application Priority Data

Jan. 12, 1996 [JP] Japan ..... 8-004040
Jun. 10, 1996 [JP] Japan ..... 8-147259

[51] Int. Cl.[6] ..... E04B 1/98

[52] U.S. Cl. ..... 52/167.1; 52/236.6

[58] Field of Search ..... 52/167.1, 773, 52/775, 235, 236.3, 236.6, 236.7, 236.8, 236.9, 475.1

[56] References Cited

U.S. PATENT DOCUMENTS

| | | | |
|---|---|---|---|
| 1,717,546 | 6/1929 | Bemis | 52/236.3 |
| 2,339,220 | 1/1944 | Crowley | 52/236.6 X |
| 4,461,130 | 7/1984 | Shubow | 52/236.6 X |
| 4,472,916 | 9/1984 | Krebs | 52/236.6 |
| 4,669,240 | 6/1987 | Amormino | 52/236.6 |
| 4,903,452 | 2/1990 | Huang | 52/236.6 X |
| 5,163,256 | 11/1992 | Fukumoto | 52/167.1 |
| 5,619,834 | 4/1997 | Chen | 52/235 X |
| 5,653,062 | 8/1997 | Shustov | 52/167.5 X |

*Primary Examiner*—Beth Aubrey
*Attorney, Agent, or Firm*—Kanesaka & Takeuchi

[57] ABSTRACT

Building walls are mounted to the frame of a building by using a plurality vibration absorbers, and therefore vibrations to the building are barely transmitted to the walls. The occurrence of cracks and breaks in external walls due to vibrations can be suppressed as much as possible, especially because the second vibration-absorbing material of the vibration absorber which is inserted into the mounting holes of the top and bottom mounting fixtures in the frame, and the first vibration-absorbing material which makes contact with the surface of external walls both have seismic isolation functions against vibrations from all directions such as horizontal, vertical, and diagonal. Secondary injury to persons and damage to objects due to breaks, and falling pieces, in external walls can be reduced. An independent seismic isolation function to each external wall mounted in each space of a frame is created. Therefore, even if an abnormal load is applied to one wall, this abnormal load is not transmitted to other walls.

11 Claims, 6 Drawing Sheets

Fig. 5(a)
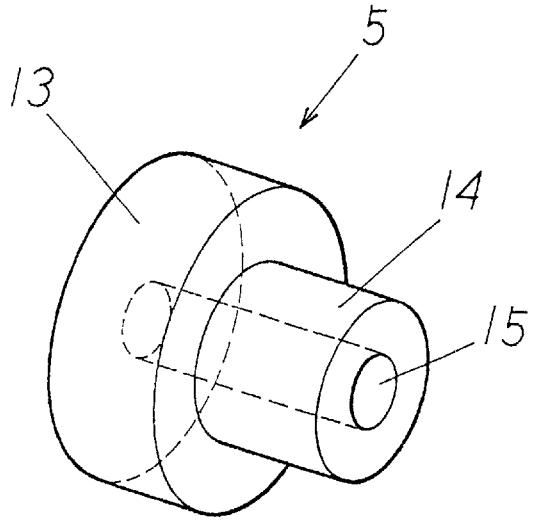
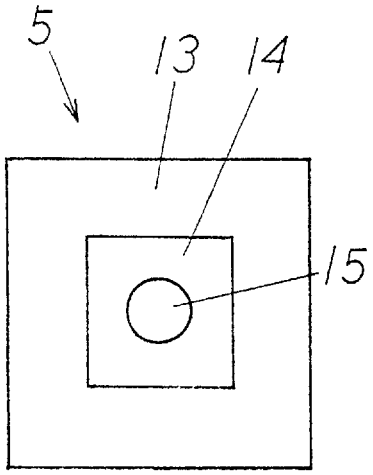
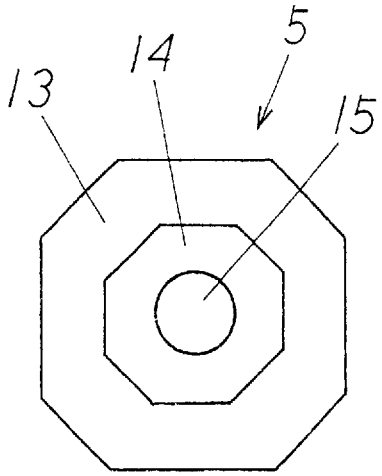
Fig. 5(b) Fig. 5(c)

APPARATUS AND METHOD FOR PROCTECTING BUILDING FROM EARTHQUAKES

BACKGROUND OF THE INVENTION AND RELATED ART STATEMENT

This invention relates to an apparatus comprising a system of components for supporting external walls of buildings and a seismic isolation method for external walls of buildings for preventing damage to walls of buildings, particularly external walls, that might be caused by vibrations of the buildings as a result of earthquakes, explosions, high wind and the like.

Currently, walls of buildings, particularly external walls, are constructed of square panels which are inserted into spaces formed by building frames such as steel frames and fixed with mounting hardware. As shown in FIG. 6, in a building frame, generally indicated by the numeral 51, constructed on a foundation 50, a panel 54 made of concrete and the like has been inserted into a space between a base 52 and beam or girder 53 and fixed to the base 52 and the beam or girder 53 with mounting hardware 55 and 56 and fixing members 57, in the form of threaded bolts and the like, near the top and bottom of the panel 54.

However, this conventional technology has problems. When the building is exposed to great vibrations such as of an earthquake, the vibrations of the building frame are directly transmitted to the concrete panel through the mounting hardware. This applies eccentric load to the panel and causes cracks and breaks in the panel. The panel becomes unusable and must be replaced. When the cracks and breaks are severe, the panel collapses or falls, usually outward, causing injury to nearby persons and damage to nearby objects.

SUMMARY OF THE INVENTION

This invention was developed to solve the aforementioned problems and its purpose is to provide a system for supporting the walls of buildings, particularly external walls, and a method for isolating them from earthquake shocks to prevent damage to such walls by using the following procedures and structures:

Mounting fixtures with bored mounting holes are fixed to the upper and lower horizontal materials in a building frame; wall panel members are inserted into the space of the building frame; vibration absorbing members are placed between the external wall and mounting fixtures so that a first vibration-absorbing material of the vibration absorbing members makes contact with the surfaces of the mounting fixture and external wall and a second vibration-absorbing material of the vibration absorbing member is inserted into the mounting hole, and then the wall panel is fixed by tightening fixing members, that may be in the form of threaded bolts, which are inserted from the outside of the mounting fixtures and screwed into the female screw hole fixtures of the wall panel through the central hole bored in the vibration absorbing members. Thanks to these structures, seismic isolation functions are effective for each wall panel, and this seismic isolation responds to vibrations from all directions including vertical, horizontal, back and forth, and diagonal components.

The invention to achieve the aforementioned purposes includes the components of the external wall supporting system and the seismic isolation method for the walls of buildings, particularly external wall panels, as described below. In a building frame, horizontal and vertical structural members form the specified square-shaped spaces for external walls. The components of the external wall supporting system to be set up in these spaces include top and bottom mounting fixtures with bored mounting holes which are fixed to the upper and lower horizontal structural members; external walls to be inserted into those spaces; several female screw hole fixtures embedded at certain intervals in the external wall; vibration absorbing members comprised of a first vibration-absorbing material placed between the top and bottom mounting fixtures and the wall panel and a second vibration-absorbing material inserted into the mounting hole; and fixing members, such as threaded bolts and the like, which are inserted from the outside of the top and bottom mounting fixtures and screwed, or other wise secured, into the female hole fixtures of the wall panel through a central hole bored in the vibration absorbing member.

A specified building frame is constructed of horizontal and vertical structural members. Wall panels are inserted into the appropriate spaces of the frame and fixed to the top and bottom mounting fixtures, which may have already been fixed to the top and bottom horizontal structural members, through vibration absorbing members by using fixing members, or bolts. In this building, the external walls are in contact with the first vibration-absorbing material of the vibration absorbing members which are placed between the external walls and the upper and lower mounting fixtures. The second vibration-absorbing material, which is connected to the first vibration-absorbing material, is inserted into the mounting hole. The wall panels are supported by the fixing members, such as threaded bolts which are screwed into the female hole fixtures of the external walls through the central hole bored in the vibration absorbing member. Horizontal vibrations of the building are absorbed by the second vibration-absorbing material of the vibration absorbing member and vertical vibrations of the building are absorbed by the first vibration-absorbing material of the vibration absorbing member. Therefore, this mechanism isolates the wall panels of the building from seismic vibrations and shocks.

The present invention composed and constructed as mentioned above achieves the following functions:

A building frame with a specified rectangular solid shape is constructed of upper and lower horizontal members and vertical members, such as support beams, cross bars, and the like. Top and bottom mounting fixtures are attached to the upper and lower horizontal members. Then the second vibration-absorbing material of the vibration absorbing members is inserted into the mounting hole of the top and bottom mounting fixtures.

The wall panels, particularly in the external walls, are inserted into the space so that the first vibration-absorbing material of the vibration absorbing members is placed in a gap between the wall panel and the top and bottom mounting fixtures. Fixing members, in the form of bolts and the like, are inserted from the outside of the top and bottom mounting fixtures and screwed, or otherwise secured, into the female screw hole fixtures embedded in the wall panel through the central hole bored in the vibration absorbing member. Thus the wall panels are fixed to the building frame through the vibration absorbing members.

As a result, the horizontal vibrations of the building are absorbed by the second vibration-absorbing material of the vibration absorbing member and the vertical vibrations of the building are absorbed by the first vibration-absorbing material of the vibration absorber. Therefore, this structure performs the function of seismic isolation.

An implementation example of this invention including the system for supporting the external walls of buildings and the method for the seismic isolation of the external walls of buildings is described by using the figures in the accompanying drawings.

BRIEF DESCRIPTION OF THE DRAWINGS

FIGS. 5(*a*)–5(*c*) are examples of vibration absorbing members used in the supporting system shown in FIG. 1.

DETAILED DESCRIPTION OF THE INVENTION

Figure 1:
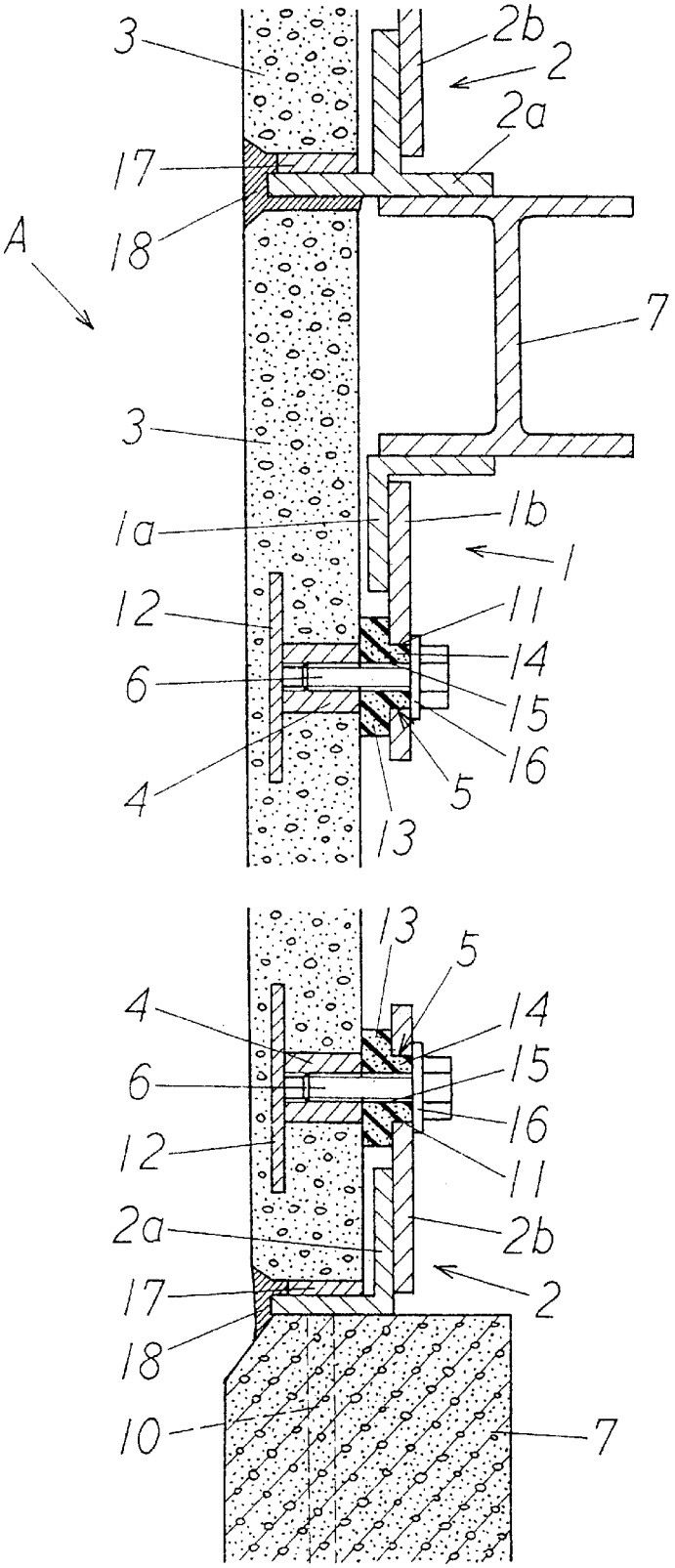
FIG. 1 is a fragmentary, cross-sectional view of a supporting system for external walls of a building adopting the seismic isolation method of this invention, showing an outline of an implementation example of the supporting system.
Figure 2:
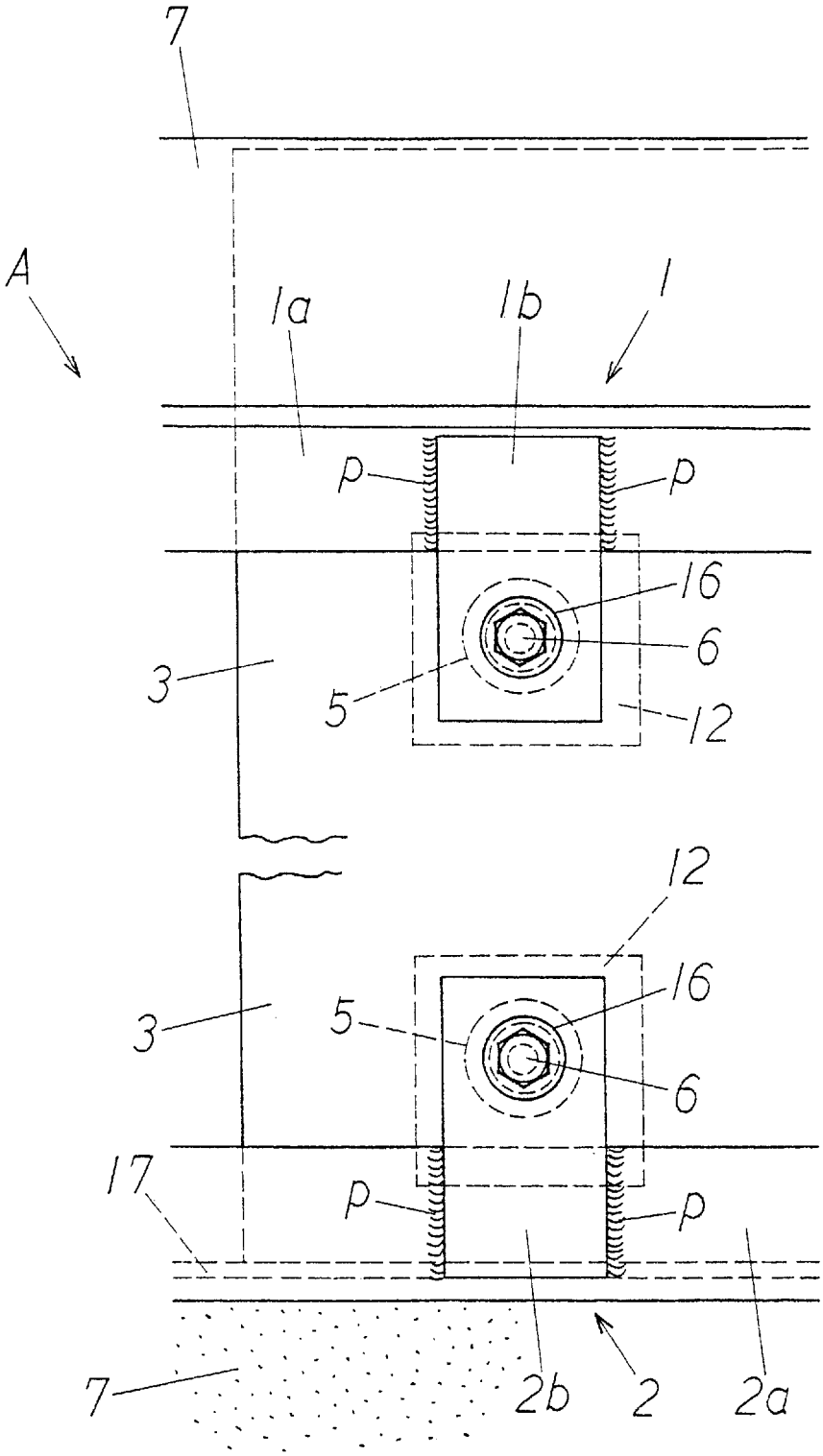
FIG. 2 is a schematic front view of the supporting system in FIG. 1.
Figure 4:
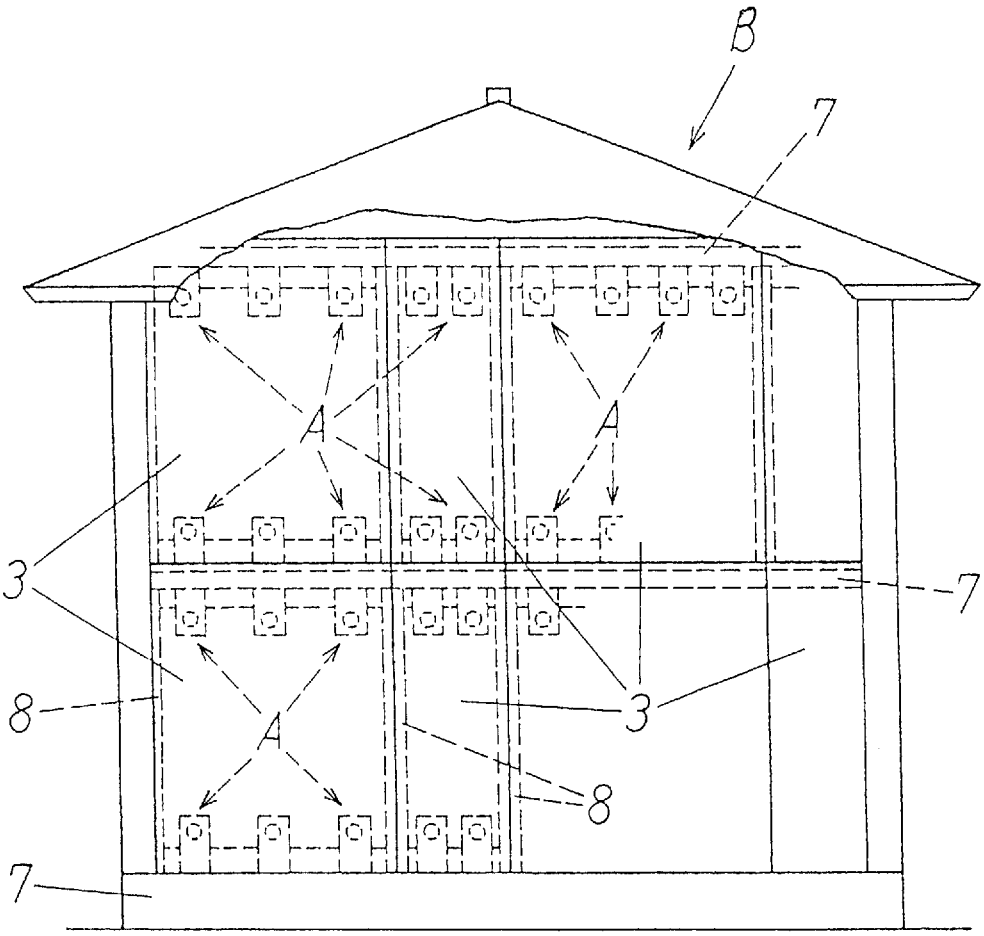
FIG. 4 is a partially exposed schematic front view of a building using the supporting system shown in FIG. 1.
Figure 6:
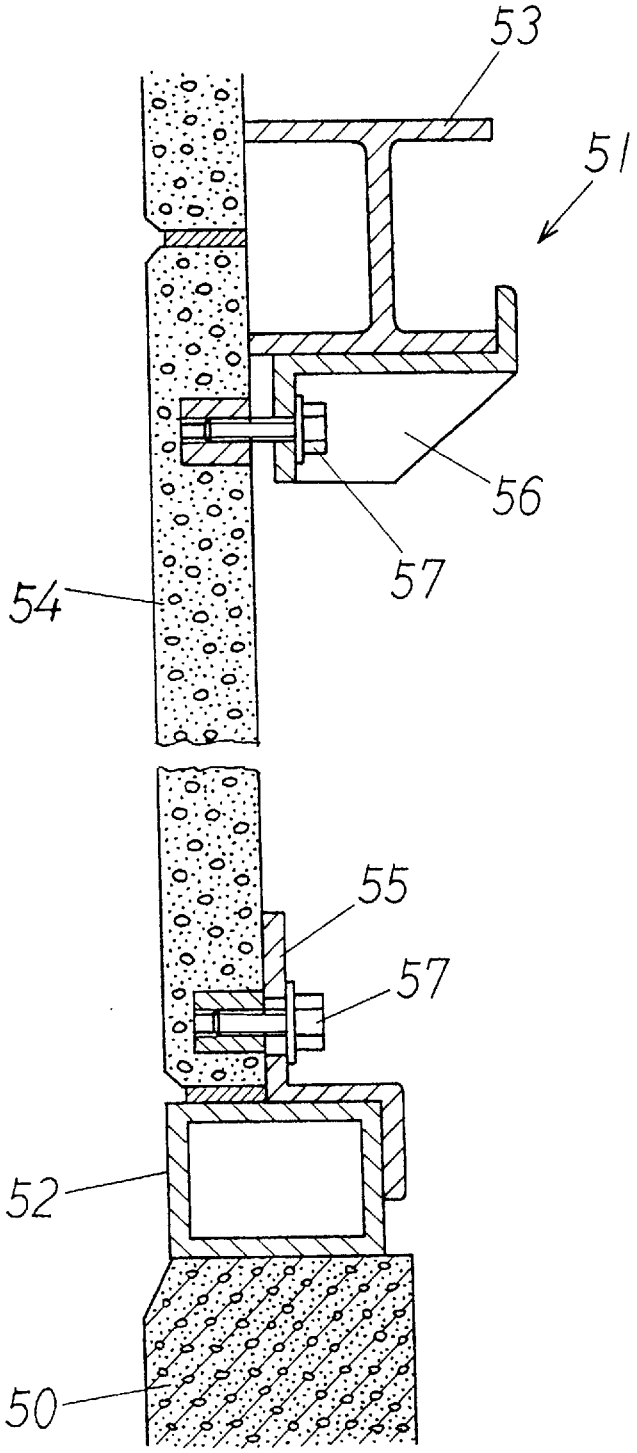
Fig. 6 Prior Art
FIG. 6 is a fragmentary, cross-sectional diagram of a conventional supporting system for the external walls of a building.

FIGS. 1, 2, and 4 illustrate a system, generally indicated by the letter "A", for supporting walls of buildings, particularly external walls, and is comprised basically of upper and lower mounting fixtures, respectively indicated by the numerals 1 and 2, a wall panel 3, female screw hole fixture 4, vibration absorbing member 5, and fixing members, or bolts, 6.

Figure 3:
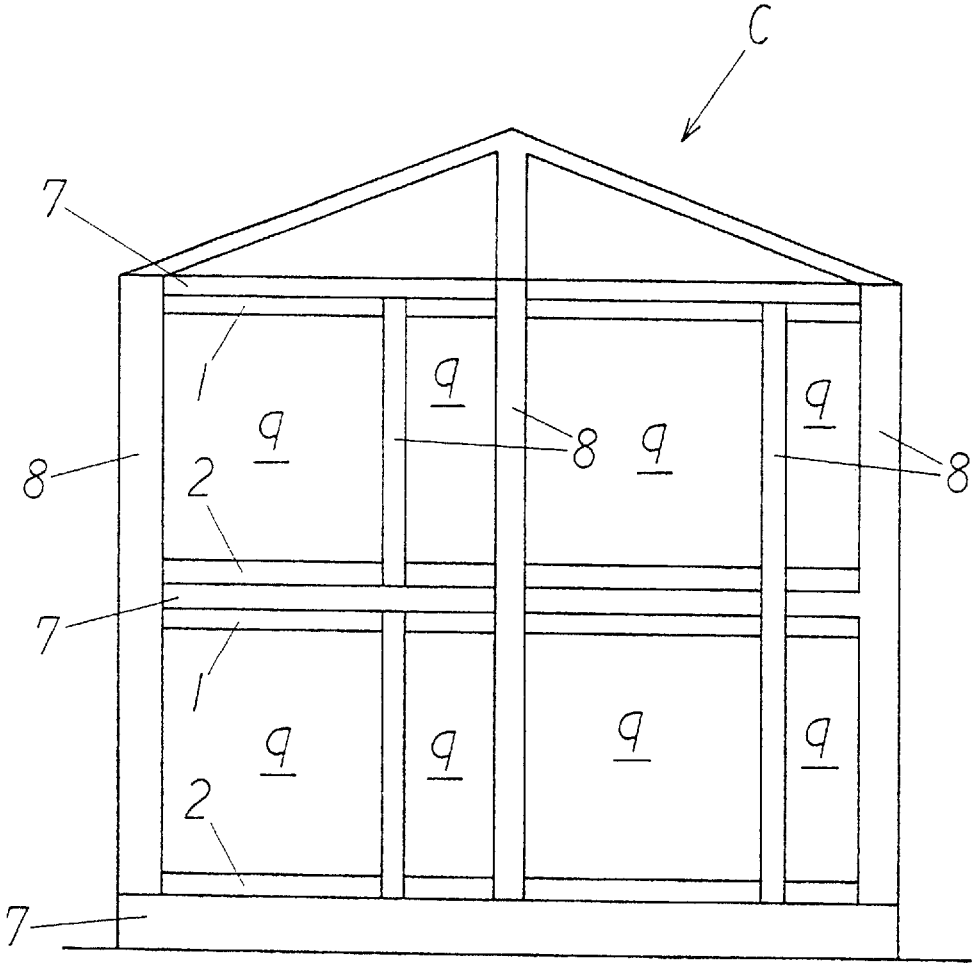
FIG. 3 is a schematic front view of a building frame to which the supporting system will be applied.

Referring to FIGS. 3 and. 4, the building, generally indicated by the letter "B", where the system A is used, can be a single-story or multiple-story building which has a frame, indicated by the latter "C", with a specified rectangular solid shape constructed of upper and lower horizontal structural members 7, such as foundation, bases, beams, and girders, and the like, and vertical structural members 8 such as pillars, posts, and the like, and is enclosed with external walls 3 assembled in appropriate spaces 9.

The top and bottom mounting fixtures 1 and 2, shown in FIGS. 1 and 2, are comprised of top and bottom lateral members 1*a* and 2*a* and top and bottom longitudinal members 1*b* and 2*b*, and are fixed to the top and bottom horizontal structural members 7.

The top and bottom lateral members 1*a* and 2*a* have an L-shaped or T-shaped cross-section and are installed in series along almost the whole length of the space 9. To fix the bottom lateral member 2*a* to the bottom horizontal structural member 7 in the first floor, one plane of the lateral member 2*a* is fixed by fixing members to the anchor 10 embedded in the bottom structural member 7, which is a concrete foundation, by welding or fastening with bolts and nuts. Another plane of the lateral member 2*a* is made to stand vertically. When the bottom lateral member 2*a* is fixed to the bottom horizontal structural member 7 in the second or higher floor, which corresponds to the top horizontal structural member in the first floor, one plane of the T-shaped lateral member 2*a* is fixed to the bottom horizontal structural member 7, which is a beam or girder, by welding or fastening with bolts and nuts, and another plane is made to stand vertically.

When the top lateral member 1*a* is fixed to the top horizontal structural member 7 in the first or higher floor, one plane of the lateral member 1*a* is fixed to the bottom plane of the top horizontal structural member 7, the beam or girder, which corresponds to the bottom horizontal structural member in a higher floor, by welding or fastening with bolts and nuts, and another plane of the lateral member 1*a* is made to hang down vertically.

The top and bottom longitudinal members 1*b* and 2*b* are rectangular-shaped and have a mounting hole 11 with a predetermined diameter bored into an off-center position. These longitudinal members 1*b* and 2*b* are fixed to the top and bottom lateral members 1*a* and 2*a* by welding or fastening with bolts and nuts at a position opposite to their mounting hole. The longer side of the rectangular-shaped longitudinal members 1*b* and 2*b* are made to hang down or stand vertically.

The top lateral member 1*a* and top longitudinal member 1*b* in the top mounting fixture 1 can be made of a steel frame material as one piece, and the same for the bottom lateral member 2*a* and bottom longitudinal member 2*b* in the bottom mounting fixture 2. Also, the top lateral member 1*a* and top longitudinal member 1*b* in the top mounting fixture 1 (or the bottom lateral member 2*a* and bottom longitudinal member 2*b* in the bottom mounting fixture 2) can remain free without the fixing of these two parts by welding or fastening with bolts and nuts (this case is not illustrated in the drawings). In this case, seismic vibrations are not transmitted because no direct joining between the horizontal structural members 7 and the top or bottom longitudinal member 1*b* or 2*b* exists. Furthermore, since this mounting method is that the top and bottom lateral members 1*a* and 2*a* are sandwiched between the external wall 3 and the top and bottom longitudinal members 1*b* and 2*b*, almost no positional shift of the external wall 3 occurs in the right and left or back and forth directions, and practically no problem occurs.

The aforementioned external walls 3 are inserted into the spaces 9 of the frame C and are rectangular-shaped panels of a size suitable for these spaces 9. For example, the panels are formed in the sizes of 3000×900 mm, 3000×1800 mm, and 3000×2500 mm in height×width and 50–100 mm in thickness, and are made of precast concrete, aerated concrete, and gypsum board.

The external wall 3 contains several female screw hole fixtures 4 which are embedded near the top and bottom ends of the external wall with certain intervals and into which fixing members 6 are screwed. The outer end of this fixture 4 is almost level with the surface of the external wall 3 and the inner end of this fixture 4 inside the wall is attached to the reinforcing plate 12 which extends outward of the female screw hole fixture 4.

The aforementioned vibration absorber 5 is made of hard elastic rubber and placed in the gap between the top and bottom mounting fixtures 1 and 2 and the external wall 3. As shown in FIGS. 1 and 5, this vibration absorber consists of the first vibration-absorbing material 13 which makes contact with the external wall and the mounting fixture and the second vibration-absorbing material 14 which extends from the first vibration-absorbing material 13 with a certain size different from or the same as that of the first vibration-absorbing material 13. The second vibration-absorbing materials 14 are inserted into the mounting holes of the longitudinal members 1*b* and 2*b* in the top and bottom mounting fixtures.

This vibration absorber 5 has a bored through-hole 15 at its center whose axis is perpendicular to the plane of the external wall 3.

Also this vibration absorber 5 is shaped in the circular cross-section shown in FIG. 5(*a*), in the square cross-section shown in FIG. 5(*b*), or in the polygon cross-section shown in FIG. 5(*c*), with an even thickness around the through-hole 15. This thickness can be designed and changed in response to the structure of the building B and the size and weight of the external wall 3.

The aforementioned fixing member, or bolt, 6 is inserted from the outside of the longitudinal members 1*b* and 2*b* of the top and bottom mounting fixtures 1 and 2 through the through-hole 15 of the vibration absorber 5 and screwed into the female screw hole fixture 4 of the external wall 3. Commonly available hexagonal headed machine bolts are used as this fixing bolt and a proper flat washer 16 is placed between longitudinal members 1*b* and 2*b* and the head of the fixing bolt 6.

In FIG. 1, a buffer material 17 is shown adhering to the bottom lateral member 2*a* in the bottom mounting fixture 2 and absorbs unexpected vertical, horizontal, and diagonal vibrations applied to the external wall 3 in addition to supporting the weight of the external wall 3. It is made of hard elastic rubber and is shaped into a band with proper width on which the external wall 3 can be stably set.

This invention's system A for supporting the external walls of the buildings described above is applied to the specified building frame C made of a steel frame of a rectangular solid shape, as shown in FIG. 3, which is constructed of the concrete foundation 7 deposited on the building site for the steel framed building B, horizontal structural members 7 such as beams and girders, and vertical structural members 8 such as pillars.

In the space 9 of the frame C, the top and bottom mounting fixtures are fixed to the top horizontal material beams and girders 7 and the bottom horizontal material concrete foundation (or steel frame structural members as a base), respectively, as follows. First, the bottom lateral member 2*a* in the bottom mounting fixture 2 is placed on the concrete foundation 7 and then is fixed to the anchor 10 becoming one-piece.

Then the top lateral member 1*a* in the top mounting fixture 1 is welded to the bottom surface of the beam or girder 7, to be fixed.

Next, the top and bottom longitudinal members 1*b* and 2*b* are welded (shown at "P" in FIG. 2) to the already fixed top and bottom lateral members 1*a* and 2*a* at the locations matching the locations of the female screw hole fixtures 4 embedded in the external walls 3 to be inserted in the spaces 9. Otherwise, members 1*a*, 2*a* and 1*b*, 2*b* can remain free without being fixed. In this case, the rotational movement of the top and bottom longitudinal members 1*b* and 2*b* is prevented by the top and bottom lateral members 1*a* and 2*a* or the horizontal materials 7 making contact with each end of members 1*b* and 2*b*.

The vibration absorbers 5 are placed so as to insert the second vibration-absorbing material 14 into the mounting holes 11 of the top and bottom mounting fixtures 1 and 2 and locate the first vibration-absorbing material 13 outside.

Then each external wall 3 is placed in each space 9 of the frame C and settled on the buffer material 17 on the bottom lateral member 2*a*.

At this stage, an appropriate gap is created between the external wall 3 and the top and bottom longitudinal members 1*b* and 2*b*, and the first vibration-absorbing material 13 of the vibration absorber 5 is sandwiched between the external wall and the longitudinal member. The fixing members, or bolts, 6 are inserted from the outside of the top and bottom longitudinal members 1*b* and 2*b*, namely the inside of building B, through the through-hole 15 bored at the center of the vibration absorber 5 and screwed, or otherwise secured, into the female screw hole fixtures 4 embedded in the external wall 3. Thus this external wall 3 is fixed to the frame C through the vibration absorber 5 and the top and bottom mounting fixtures 1 and 2 by tightening the fixing members 6.

The vertical load of the external wall 3 is supported by the bottom horizontal material 7 and almost none of this load is applied to the vibration absorber 5.

The resulting structure of the external walls 3 mounted into the frame C is shown in FIG. 4. The gap between the neighboring external walls 3 is filled with commonly used caulking material 18.

The mounting method of the external walls 3 for the first floor can be similarly applied for the second and higher floors using the aforementioned system A.

The horizontal vibrations of the building B caused by earthquakes and the like are transmitted to the top and bottom longitudinal members 1*b* and 2*b* in the top and bottom mounting fixtures 1 and 2 from the frame C, but they are absorbed by the second vibration-absorbing material 14 of the vibration absorber 5 inserted into the mounting holes 11 of these top and bottom longitudinal members 1*b* and 2*b*.

Also the vertical vibrations of the building B are transmitted to the top and bottom longitudinal members 1*b* and 2*b* in the top and bottom mounting fixtures 1 and 2 from the frame C, but they are absorbed by the first vibration-absorbing material 13 of the vibration absorber 5 between the external wall 3 and the top and bottom longitudinal members 1*b* and 2*b*.

That is, in the building B, vibrations which might have been applied to the external walls 3 from all directions such as back and forth, right and left, and diagonal, can be absorbed by the vibration absorber 5 and are hardly transmitted to the external walls 3.

As described above, in the present invention, external walls are mounted to the frame of a building through vibration absorbers, and therefore vibrations to the building are barely transmitted to the external walls. The occurrence of cracks and breaks in external walls due to vibrations can be suppressed as much as possible, especially because the second vibration-absorbing material of the vibration absorber which is inserted into the mounting holes of the top and bottom mounting fixtures in the frame, and the first vibration-absorbing material which makes contact with the surface of external walls both have seismic isolation functions against vibrations from all directions such as horizontal, vertical, and diagonal.

Furthermore, secondary injury to persons and damage to objects due to breaks in external walls can be prevented.

This system can provide an independent seismic isolation function to each external wall mounted in each space of a frame. Therefore, even if an abnormal load is applied to one external wall, this abnormal load is not transmitted to other external walls. These are the particular effects of the present invention.

What is claimed is:

1. A system for supporting walls of a building with a building frame constructed of upper and lower horizontal structural members and spaced vertical structural members, which create rectangular spaces for the walls, comprising:

top and bottom mounting fixtures adapted to be fixed to said upper and lower horizontal structural members and having mounting holes therein;

wall panels adapted to be inserted into said spaces to form gaps relative to the top and bottom mounting fixtures;

a multiple number of female fixtures embedded in said wall panels spaced apart from each other;

vibration absorbers, each being comprised of a first vibration-absorbing material which is placed in one gap formed between one of said top and bottom mounting fixtures and one of said wall panels and a second vibration-absorbing material which is inserted into one of said mounting holes; and fixing members secured in said female fixtures and to said top and bottom mounting fixtures, each fixing member passing through a through-hole bored substantially at a central position of the vibration absorbers.

2. The system as defined in claim 1, wherein each of said top and bottom mounting fixtures includes top and bottom lateral members and top and bottom longitudinal members, and said top and bottom lateral members are adapted to be fixed to said upper and lower horizontal structural members.

3. The system as defined in claim 2, wherein said top and bottom longitudinal members are connected to said top and bottom lateral members by welding.

4. The system as defined in claim 2, wherein said top and bottom longitudinal members are installed under conditions permitting free-sliding contact relative to said top and bottom lateral members.

5. The system as defined in claim 1, wherein each vibration absorber is made of hard elastic rubber.

6. The system as defined in claim 1, wherein said second vibration-absorbing material extends from said first vibration-absorbing material and has a diameter smaller than that of said first vibration-absorbing material for creating a specified size difference.

7. The system as defined in claim 2, wherein a flat plane of said first vibration-absorbing material on a side of the second vibration-absorbing material is arranged for making contact with one of surfaces of the top and bottom longitudinal members in the top and bottom mounting fixtures.

8. The system as defined in claim 1, wherein each of said wall panels adapted to be inserted into said spaces of the building frame is adapted to be placed on one of said lower horizontal structural members, and a buffer material is provided for supporting each of said wall panels thereon.

9. A method for damping seismic vibrations of a building, said method comprising the steps of:

providing a building including upper and lower horizontal structural members and spaced vertical structural members for forming rectangular spaces therebetween;

providing a plurality of vibration absorbing members, each being comprised of first and second vibration absorbing portions and having a through-hole passing therethrough, installing mounting fixtures with mounting holes to said upper and lower horizontal structural members, inserting a plurality of wall panels in said rectangular spaces and fixing said wall panels to said mounting fixtures with a plurality of fixing members, each of said vibration absorbing members being arranged with respect to each of said wall panels and each of said mounting fixtures such that said first vibration absorbing portion is placed between said wall panel and said mounting fixture, and said second vibration absorbing portion is placed in said mounting hole, and fixing said vibration absorbing members between said wall panels and said mounting fixtures by said fixing members passing through said through-holes.

10. The method as defined in claim 9, wherein said wall panels include female fixtures embedded therein, said fixing members engaging said female fixtures when the wall panels are fixed to the mounting fixtures.

11. The method as defined in claim 9, wherein said mounting fixtures are welded to said structural members.

* * * * *